US006369710B1

(12) United States Patent
Poticny et al.

(10) Patent No.: US 6,369,710 B1
(45) Date of Patent: Apr. 9, 2002

(54) WIRELESS SECURITY SYSTEM

(75) Inventors: David Margin Poticny, Chester; R. Anthony Shober, Red Bank, both of NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/534,851

(22) Filed: Mar. 27, 2000

(51) Int. Cl.[7] ..... G08B 13/14

(52) U.S. Cl. ..... 340/572.1; 340/573.3; 340/573.4; 340/573.6

(58) Field of Search ..... 340/573.4, 573.3, 340/573.6, 572.1, 5.92, 10.1, 505, 539

(56) References Cited

U.S. PATENT DOCUMENTS 3,720,940 A 3/1973 Fox et al.

(List continued on next page.)

FOREIGN PATENT DOCUMENTS

EP 0 313 491 A1 4/1989

(List continued on next page.)

OTHER PUBLICATIONS

"A Microwave Noncontact Identification Transponder Using Subharmonic Interrogation," Carol W. Pobanz, 8099 IEEE Transactions on Microwave Theory and Techniques, 43 (1995), Jul., No. 7, PT. II, New York, US, pp. 1673–1679.

"A Coded Radar Reflector For Remote Identification Of Personnel And Vehicles," Frank R. Williamson, Lacey F. Moore, Ralph Brooks, Julie Anne Williamson, and Melvin C. McGee, Record of the 1993 IEEE National Radar Conference, Lynnfield, MA, USA, Apr. 20–22, 1993, ISBN 0–7803–0934–0, pp. 186–191.

*Primary Examiner*—Thomas Mullen
(74) *Attorney, Agent, or Firm*—Irena Lager

(57) ABSTRACT

A system provides a mobile transmitter and a plurality of boundary tags for receiving communication from the mobile transmitter. Preferably the mobile transmitter is coupled to a mobile unit, which can be an inanimate object capable of moving or being moved, or a living being. The boundary tags mark the boundaries of an area within which the mobile unit is allowed to move. The mobile transmitter transmits a signal to a boundary tag. The system determines if the mobile transmitter has come into proximity of a boundary tag by receiving a reflected modulated signal from the boundary tag. If the mobile transmitter has come into proximity of a boundary tag a response is generated. The response can be a stimulus or an alert, or both. The response can be generated at a central control station, or at a mobile transceiver that includes the mobile transmitter and a mobile receiver. In one embodiment, the boundary tag modulates a reflection of the signal transmitted by the mobile transmitter. This reflected modulated signal can be received by either the mobile transmitter or by the central control station. In an alternative embodiment invention, the boundary tag records the receipt of the signal from the mobile transmitter. The central control station transmits a second signal to the boundary tag. The boundary tag modulates a reflection of the second signal to produce the reflected modulated signal, which is then received at the central control station. Optionally, the boundary tags may have unique identifiers. The system could then include a processor programmed to determine if the mobile transmitter is in proximity of a boundary tag whose unique identifier matches one of the predetermined unique identifiers. The processor can be located in the central control station, or in the transceiver, or in another location in the system.

18 Claims, 7 Drawing Sheets

U.S. PATENT DOCUMENTS 3,938,052 A 2/1976 Glasson et al.
3,944,928 A 3/1976 Augenblick et al.
3,984,835 A 10/1976 Kaplan et al.
3,997,847 A 12/1976 Tong
4,068,232 A 1/1978 Meyeres et al.
4,075,632 A 2/1978 Baldwin et al.
4,360,810 A 11/1982 Landt
4,471,345 A 9/1984 Barrett, Jr.
4,510,495 A 4/1985 Sigrimis et al.
4,584,534 A 4/1986 Lijphart et al.
4,641,374 A 2/1987 Oyama
4,656,463 A 4/1987 Anders et al.
4,691,202 A 9/1987 Denne et al.
4,737,789 A 4/1988 Nysen
4,739,328 A 4/1988 Koelle et al.
4,816,839 A 3/1989 Landt
4,827,395 A 5/1989 Anders et al.
4,888,591 A 12/1989 Landt et al.
4,912,471 A 3/1990 Tyburski et al.
4,937,581 A 6/1990 Baldwin et al.
4,963,887 A 10/1990 Kawashima et al.
4,993,068 A 2/1991 Piosenka et al.
4,999,590 A * 3/1991 Verdot ..... 332/104
5,030,807 A 7/1991 Landt et al.
5,039,994 A 8/1991 Wash et al.
5,051,741 A * 9/1991 Wesby ..... 340/825.49
5,055,659 A 10/1991 Hendrick et al.
5,086,391 A 2/1992 Chambers
5,131,038 A 7/1992 Puhl et al.
5,153,919 A 10/1992 Reeds
5,164,985 A 11/1992 Nysen et al.
5,214,409 A 5/1993 Beigel
5,214,410 A 5/1993 Verster
5,227,803 A 7/1993 O'Connor et al.
5,241,923 A * 9/1993 Janning ..... 340/573.1 X
5,251,218 A 10/1993 Stone et al.
5,252,979 A 10/1993 Nysen
5,264,854 A 11/1993 Spiess
5,305,008 A 4/1994 Turner et al.
5,305,459 A 4/1994 Rydel
5,317,309 A 5/1994 Vercellotti et al.
5,339,073 A 8/1994 Dodd et al.
5,347,263 A 9/1994 Carroll et al.
5,381,137 A 1/1995 Ghaem et al.
5,390,339 A 2/1995 Bruckert et al.
5,400,949 A 3/1995 Hirvonen et al.
5,410,315 A 4/1995 Huber
5,420,757 A 5/1995 Eberhardt et al.
5,423,056 A 6/1995 Linquist et al.
5,425,032 A 6/1995 Shloss et al.
5,426,667 A 6/1995 van Zon
5,434,572 A 7/1995 Smith
5,438,329 A 8/1995 Gastouniotis et al.
5,448,110 A 9/1995 Tuttle et al.
5,448,242 A 9/1995 Sharpe et al.
5,455,575 A 10/1995 Schuermann
5,461,385 A 10/1995 Armstrong
5,463,402 A 10/1995 Walrath et al.
5,477,215 A 12/1995 Mandelbaum
5,478,991 A 12/1995 Watanabe et al.
5,479,160 A 12/1995 Koelle
5,479,416 A 12/1995 Snodgrass et al.
5,485,520 A 1/1996 Chaum et al.
5,491,484 A 2/1996 Schuermann
5,510,795 A 4/1996 Koelle
5,521,944 A 5/1996 Hegeler et al.
5,523,749 A 6/1996 Cole et al.
5,525,993 A 6/1996 Pobanz et al.
5,525,994 A 6/1996 Hurta et al.
5,530,202 A 6/1996 Dais et al.
5,543,798 A 8/1996 Schuermann
5,559,828 A 9/1996 Armstrong et al.
5,565,858 A 10/1996 Guthrie
5,572,222 A 11/1996 Mailandt et al.
5,581,576 A 12/1996 Lanzetta et al.
5,590,158 A 12/1996 Yamaguchi et al.
5,600,538 A 2/1997 Xanthopoulos
5,610,939 A 3/1997 Takahashi et al.
5,633,613 A 5/1997 MacDonald
5,640,683 A 6/1997 Evans et al.
5,649,295 A 7/1997 Shober et al.
5,649,296 A 7/1997 MacLellan et al.
5,686,920 A 11/1997 Hurta et al.
5,686,928 A 11/1997 Pritchett et al.
5,708,444 A 1/1998 Pouwels et al.
5,727,027 A 3/1998 Tsuda
5,774,673 A 6/1998 Beuk et al.
5,774,876 A 6/1998 Woolley et al.
5,796,827 A 8/1998 Coppersmith et al.
5,804,810 A 9/1998 Woolley et al.
5,850,187 A 12/1998 Carrender et al.
5,852,403 A 12/1998 Boardman
5,872,516 A 2/1999 Bonge, Jr.
5,873,025 A 2/1999 Evans et al.
5,874,903 A 2/1999 Shuey et al.
5,929,779 A 7/1999 MacLellan et al.
5,940,006 A 8/1999 MacLellan et al.
5,952,922 A 9/1999 Shober
6,046,683 A * 4/2000 Pidwerbetsky et al. ..... 340/572.1 X
6,137,414 A * 10/2000 Federman ..... 340/572.9

FOREIGN PATENT DOCUMENTS

EP 0 346 922 A2 12/1989
EP 0 520 445 A2 12/1992
EP 0 670 558 A2 2/1995
EP 0 724 351 A2 7/1996
EP 0 732 597 A1 9/1996
EP 0 750 200 A 12/1996
EP 0 750 201 A1 12/1996
EP 0779 520 A2 12/1996
GB 1 098 431 A 11/1982
GB 2 193 359 A 2/1988
GB 2 202 415 A 9/1988
JP 52082 3/1988
JP H10-206538 8/1998
WO WO 89/05549 6/1989
WO WO 94/19781 9/1994

WIRELESS SECURITY SYSTEM

RELATED APPLICATIONS

Related subject matter is disclosed in the following applications and assigned to the same Assignee hereof: U.S. Pat. Nos. 5,649,295, 5,649,296, 5,940,006, and 5,952,922.

FIELD OF THE INVENTION

This invention relates to wireless communication systems and, more particularly, to a wireless communication system used as a security system.

BACKGROUND OF THE INVENTION

In some types of security systems it is desired to allow a mobile unit to be able to move throughout a predetermined area in safety. Such systems would generate an alert of some type when the mobile unit moves out of the predetermined area. The mobile unit can be any inanimate object, such as a motor vehicle or a container capable of being transported, or the mobile unit can be any living being, such as a pet or a human.

Some security systems utilize a centralized radio transmitter with a radio receiver located on the mobile unit. When the mobile unit strays out of range of the transmitter, the radio receiver assumes the mobile unit has strayed out of the predetermined area and provides some sort of feedback to the mobile unit. Additionally, other systems have been developed (see U.S. Pat. Nos. 5,852,403 and 5,872,516) to track the movements of pets and provide feedback if the pet strays from a predetermined area. One such system utilizes a radio transmitter that sends a radio signal to a radio receiver located on the pet. The radio receiver senses phase differences to determine if the pet has strayed out of the predetermined area. Another such system provides for a multiplicity of ultrasonic radio transmitters, stationed around the periphery of the predetermined area, which transmit to an ultrasonic receiver located on the pet. Based on the presence or absence of the received ultrasonic signal, the receiver determines if the pet has strayed from the predetermined area and provides some sort of feedback to the pet. Other pet security systems on the market today utilize lengths of wire strung underground, the length of wire mark the periphery of the predetermined area. A radio receiver located on the pet can sense the presence of the underground wire and, in a similar manner to the above, provide some sort of feedback if the pet has strayed from the predetermined area.

There are various problems with each of the above systems. Systems involving lengths of wire buried underground are expensive to install and repair. These systems are also difficult to install if a solid obstruction, for example a driveway, is in the way. Furthermore, various "accidents" can cut the wires, thus rendering the system non-functional. Additionally, the system could be extremely difficult to repair since it may not be evident at what specific location the wires are broken.

Systems that assume that the pet has left the predetermined area when no longer in communication with the radio transmitter also have deficiencies. First, the predetermined area may be of limited size depending upon the maximum transmit power of the central radio transmitter allowed under local or federal law. Second, radio systems are notorious for being susceptible to variations in the received signal strength of a radio signal from well-known phenomena such as shadow fading, multipath fading, etc. Therefore, simply because the pet's radio receiver does not receive radio messages for a period of time does not mean that the pet has strayed from the predetermined area. Third, such a system does not easily allow for an irregularly shaped predetermined area. For example, if the predetermined area has a swimming pool in the middle, the pet owner may wish to allow the pet access to the entire area with the exception of the pool area. A system that utilizes a radio transmitter that sends a radio signal to a radio receiver located on the pet could not cover this circumstance.

The system utilizing a multiplicity of ultrasonic radio transmitters transmitting to an ultrasonic receiver located on the pet is somewhat better in design, as it could to some degree handle irregularly shaped predetermined areas. However, the presence of an ultrasonic transmitter is costly both from the standpoint of electrical power and the cost of each such transmitter. Furthermore, the orientation of the receiver, such as whether the receiver was in a line of sight orientation with the ultrasonic transmitter or was shielded by the body of the pet, would tend to make the specific dividing line between the predetermined area and unsafe areas fuzzy and non-specific. The propagation characteristics of such a transmitter are such that the incident energy decreases as the square of the distance; a communications technology in which the incident energy decreased more rapidly than the square of the distance would tend to create a more clearly defined dividing line. Thus, a fully deployed system utilizing the ultrasonic technology for an extremely irregularly shaped predetermined area could be costly, the dividing lines could be difficult to predict, and such a system may also be difficult to maintain due to the cost and/or complexity of equipment involved in such a system. For example the cost of battery replacement in such a system can be very costly.

Therefore, the objective of this invention is to develop a system that does not suffer from the problems mentioned above. Specifically, a system is needed that can handle predetermined areas of arbitrary geometry with relatively clearly defined dividing lines without drastically increasing the cost or the complexity of installation or maintenance.

SUMMARY OF THE INVENTION

The invention solves the above and other problems by providing a system that includes a mobile transmitter and a plurality of boundary tags for receiving communication from the mobile transmitter. The mobile transmitter can be part of a mobile transceiver that also includes a mobile receiver. Preferably the mobile transmitter is coupled to a mobile unit, which can be an inanimate object capable of moving or being moved, or it can be coupled to a living being. The placement of the boundary tags mark the boundaries of a predetermined area, i.e., the area within which the mobile unit is allowed to move.

The mobile transmitter transmits a signal to at least one boundary tag. The system determines if the mobile transmitter has come into proximity of the at least one boundary tag by receiving a reflected modulated signal from the at least one boundary tag. If the mobile transmitter has come into proximity of a boundary tag a response is generated. The response can be a stimulus or an alert, or both. The response can be generated at the transceiver, or at a central control station.

In one embodiment of the invention, the at least one boundary tag modulates a reflection of the signal transmitted by the mobile transmitter. This reflected modulated signal is received by the mobile transmitter. When the mobile receiver receives the reflected modulated signal, it can either: determine if the mobile transmitter has come into the proximity of a boundary tag; or it can forward information obtained from the signal to a central control station that would determine if the mobile transmitter has come into the proximity of a boundary tag.

In an alternate embodiment of the invention, the at least one boundary tag modulates a reflection of the signal transmitted by the mobile transmitter, and this reflected modulated signal is received by the central control station. Then, the central control station would determine if the mobile transmitter has come into the proximity of the boundary tag. In an additional alternative embodiment of the invention, the boundary tag records the receipt of the signal from the mobile transmitter. The central control station then transmits a second signal to the boundary tag. The boundary tag receives the second signal and modulates a reflection of the second signal to produce the reflected modulated signal, which is then received at the central control station.

Optionally, at least one boundary tag may have a unique identifier. The system can then include a processor programmed to determine if the mobile transmitter is in communication with at least one boundary tag whose unique identifier matches at least one predetermined unique identifier. This processor can be located in the central control station, or in the transceiver, or in another location in the system.

DETAILED DESCRIPTION

Overall Wireless Security System Operation

Figure 1:
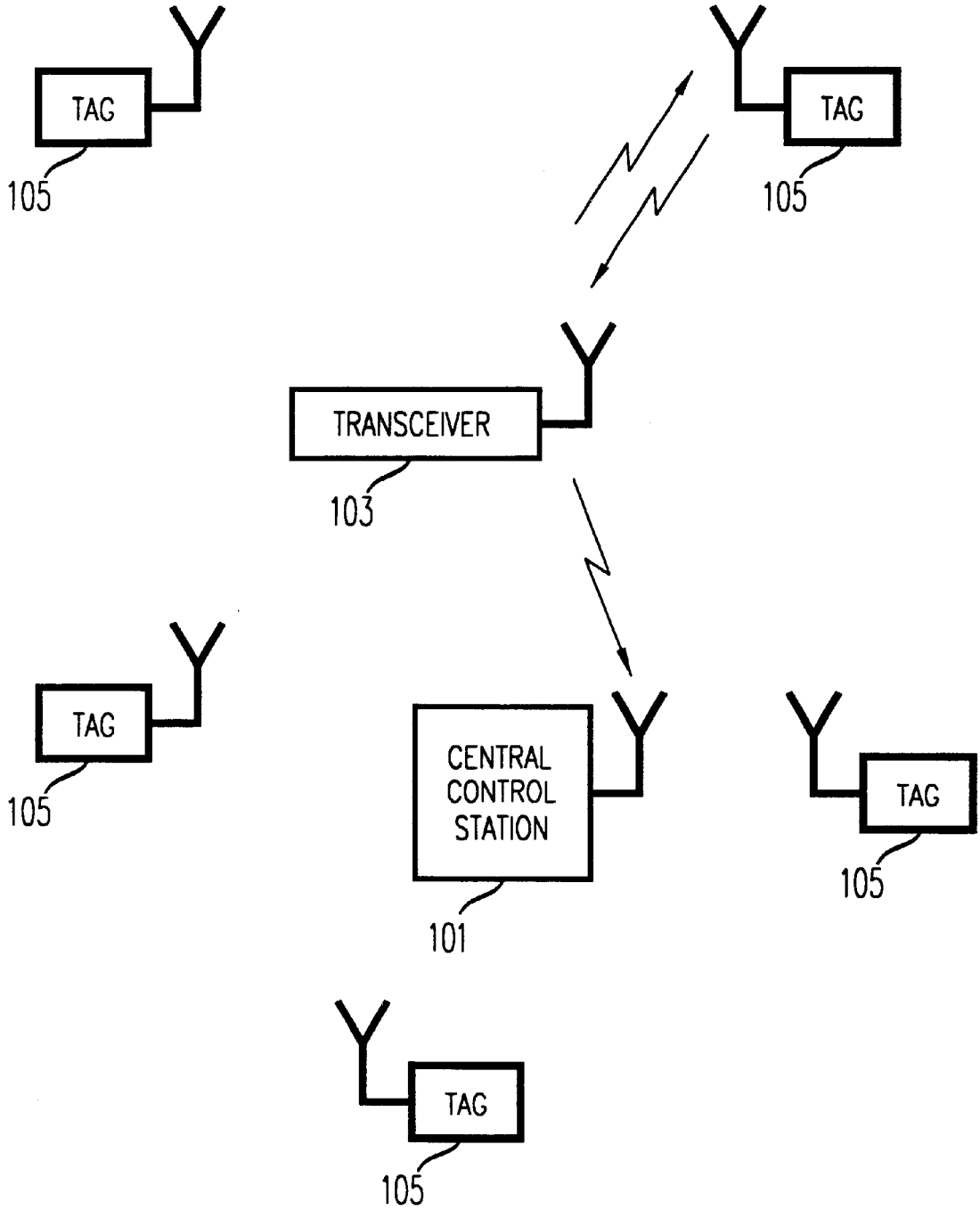
FIG. 1 shows a block diagram of an illustrative Wireless Security System.

FIG. 1 shows a Transceiver 103 attached to a mobile unit, therefore, making the Transceiver 103 a mobile transceiver. The mobile unit can be any object capable of moving or being moved. For example, the mobile unit can be an inanimate object, such as a motor vehicle or a container capable of being transported. The mobile unit can also be any living being, such as a pet or a human, for example, a mentally infirm human or a human whose movements are desired to be limited for any other reason.

Preferably, the Transceiver 103 includes a transmitter and a receiver, i.e. a mobile transmitter and a mobile receiver, although the Transceiver 103 can include just a transmitter.

The Transceiver 103 attached to the mobile unit communicates with a multiplicity of Tags 105 using modulated backscatter, described below. The Transceiver 103 further communicates with a Central Control Station 101. The Central Control Station 101 can be any processor, such as a controller, a microprocessor, or a base station-processing unit. The Tags 105 are distributed around the periphery of the predetermined area of safety, referred to herein as a predetermined area, in such a manner that they define the boundary of the predetermined area.

Figure 2:
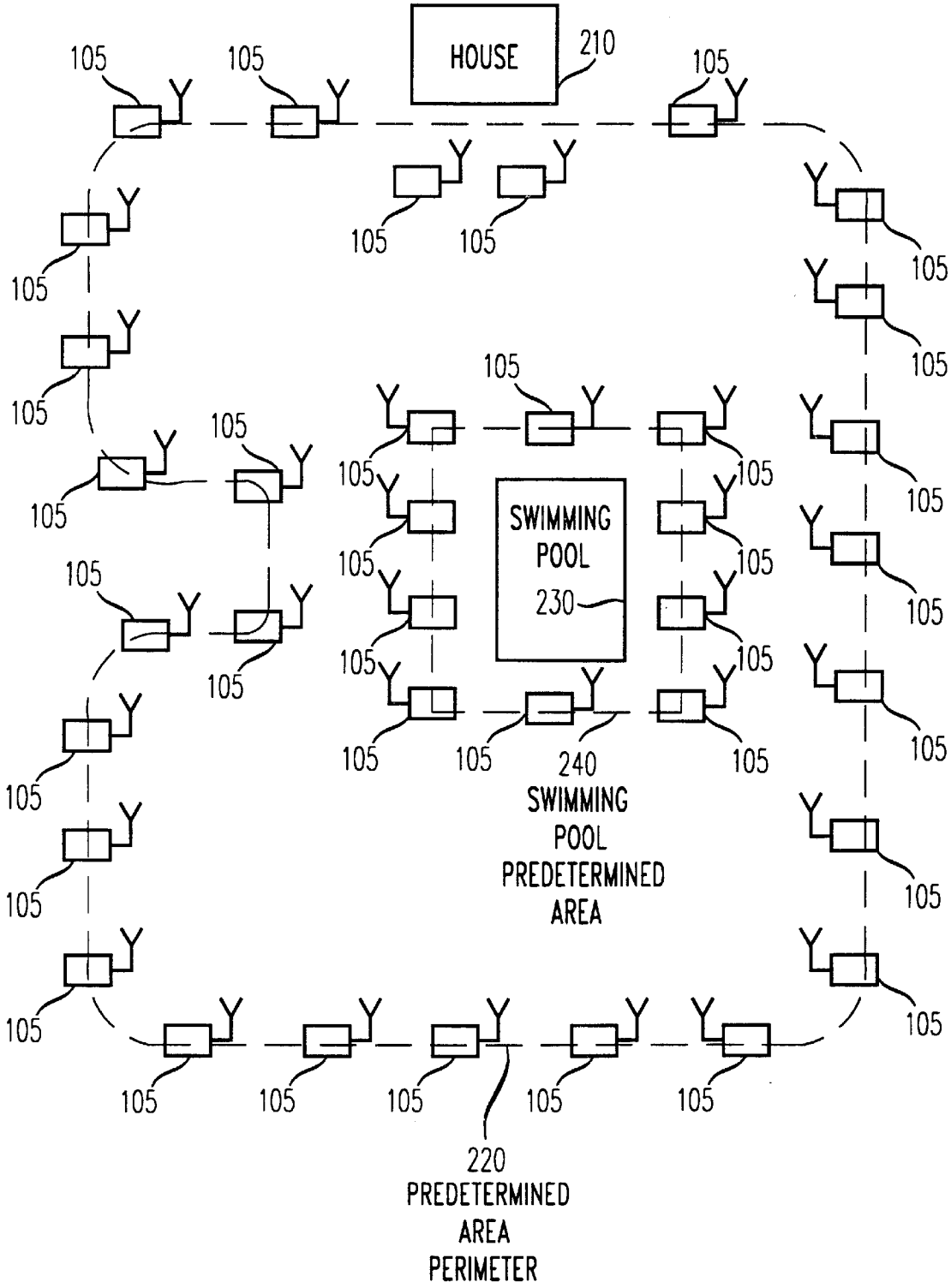
FIG. 2 shows a particular embodiment of the illustrative Wireless Security System of FIG. 1.

In addition to simply marking the external periphery of the predetermined area, the Tags 105 can be located within the predetermined area to "guard" specific areas that are unsafe, such as a swimming pool. As shown in FIG. 2, Tags 105 can be placed in an arbitrary manner to both surround the predetermined area perimeter 220, and also to surround the Swimming Pool perimeter 240, thus making the predetermined area the area with the predetermined area perimeter 220 excluding the swimming pool. This concept can be extended to exclude additional areas that are considered unsafe. Thus, the area of safety, i.e. the predetermined area, can be of arbitrary geometry.

To obtain a sharp boundary line for the area of safety, several things are needed. First, the effective range between the Transceiver 103 and the Tags 105 should be relatively short; the shorter the range, the more crisply the boundary line can be established. Second, given the relatively short range, a number of Tags 105 are required to define the boundary lines. Thus, it is desirable for the Tags 105 to be relatively inexpensive. Modulated backscatter meets both of these criteria. Modulated backscatter can be used for communications between the Transceiver 103 and the Tags 105. As discussed below, the signal strength of a modulated backscatter system decreases at least at the fourth power of the distance between the Transceiver 103 and the Tags 105. Furthermore, modulated backscatter has no active radio transmitter in the Tag 105 and thus the electrical components in the Tag 105 are not costly; therefore the Tag 105 can be inexpensively manufactured and a number of such Tags 105 can be deployed. It is preferable for the Tags 105 to have their own electrical power. Thus, if a battery is used to power the Tags 105, it is desirable to use a technology that allows long battery life.

The Tags 105 could be deployed throughout the area of safety in a number of ways. For example, the Tags 105 could be built into a stake or marker and driven into the ground with the Tag 105 visible at the surface. Alternately, the Tags 105 could be buried underground at a relatively shallow depth. One advantage of building the Tag 105 into a stake or marker would be that the Tags 105 could be located easily and re-positioned as required.

The Transceiver 103 regularly transmits a radio signal to the Tags 105 inviting any Tag 105 in range to respond using modulated backscatter. The frequency of these radio transmissions is calculated based upon the maximum speed of the mobile unit and the effective range between the Transceiver 103 and the Tag 105. The objective in determining a desirable frequency being to minimize the likelihood that the Transceiver 103 would pass out of the predetermined area without communicating with a Tag 105 that marks the boundary of that area.

Modulated Backscatter Operation

Figure 3:
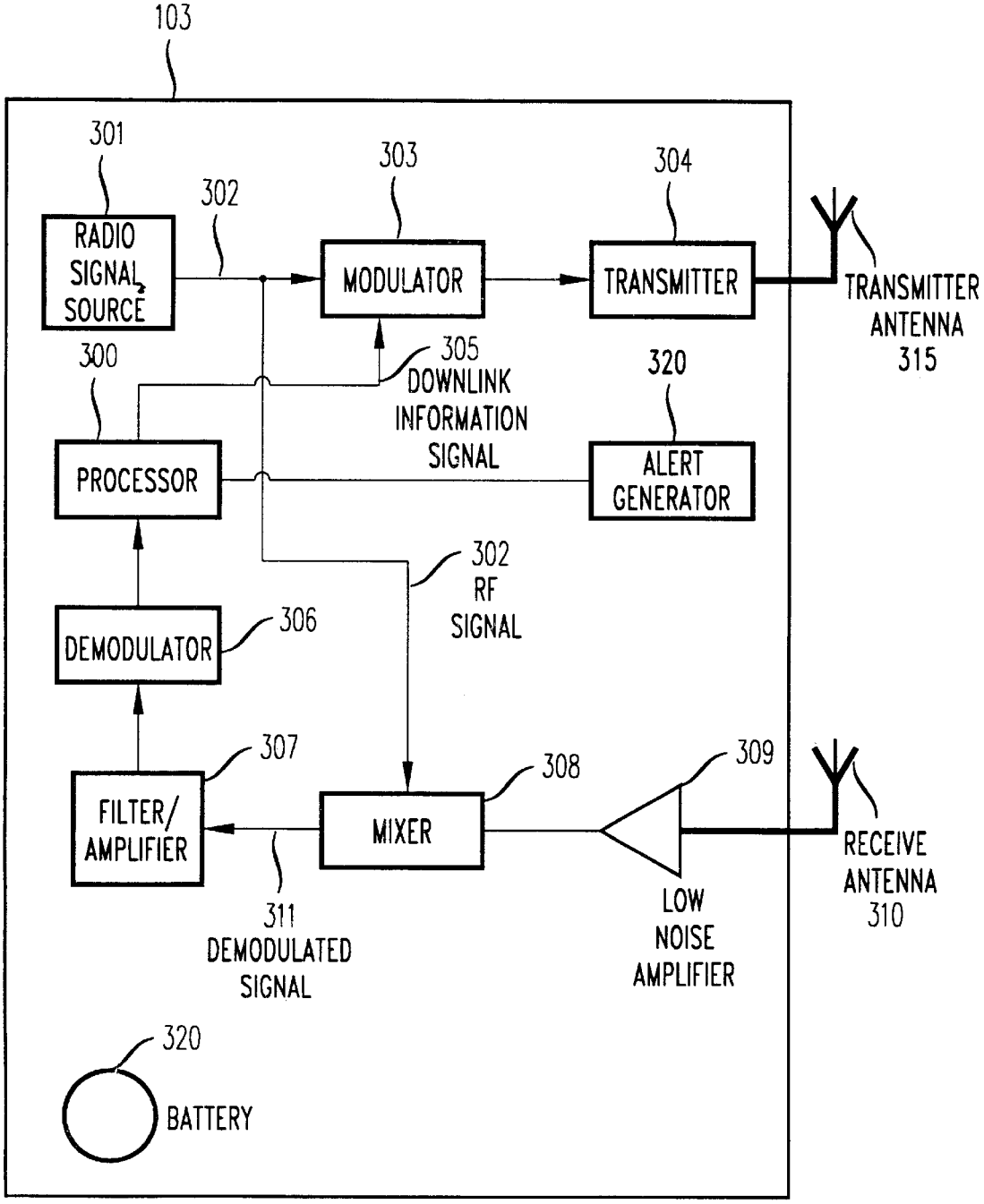
FIG. 3 shows a block diagram of an illustrative Transceiver used in the Wireless Security System of FIG. 1.

The operation of a typical modulated backscatter system is now described. FIG. 3 shows an overall block diagram of a Transceiver 103. The Transceiver 103 contains a Radio Signal Source 301 that generates an RF Signal 302, typically a continuous wave (CW) signal. The RF Signal 302 is sent to the Modulator 303. When a Downlink Information Signal 305 is to be transmitted, then the Modulator 303 modulates the Downlink Information Signal 305 onto the RF Signal 302 using any one of a number of conventional modulation techniques, such as Amplitude Modulation (AM), Phase Modulation (PM), or Code Modulation (CM), to produce a modulated signal. The modulated signal is then transmitted by the Transmitter 304, which sends this signal via Antenna 315 to a Tag 105. When a Downlink Information Signal 305 is not present the RF signal 302 passes through the Modulator 303 and is transmitted by the Transmitter 304 via Antenna 315.

In the Tag 105 (shown in FIG. 4), the Antenna 401 (frequently a loop or patch antenna) receives an incoming signal. As described above, this signal could be the modulated signal or the RF signal. When there is Downlink Information Signal 305 modulated upon the incoming signal, then the Downlink Information Signal 305 is demodulated using the Detector/Modulator 402, which, illustratively, could be a single Schottky diode. The result of the Detector/Modulator 402 is a demodulation of the incoming signal directly to baseband. The Downlink Information Signal 305 is then amplified by Amplifier 403 and sent to the Processor 405. The Processor 405 is typically an inexpensive 4 or 8 bit microprocessor. In response to the incoming signal, the Tag 105 makes a determination if a response signal should be generated. If a response is desired, then the Tag 105 generates an Uplink Information Signal 406 to be sent from the Tag 105 back to the Transceiver 103. To accomplish this, the Uplink Information Signal 406 is sent to a Modulator Control Circuit 407, which controls the operation of the Detector/Modulator 402 by means of a Modulated Signal 411. Thus, the Modulated Signal 411, containing the Uplink Information Signal 406, is transmitted back to the Transceiver 103 using modulated backscatter. Alternately, the Modulator Control 407 could use the Uplink Information Signal 406 to modulate a Subcarrier Signal 409 generated by the Frequency Source 408. The Frequency Source 408 could be a crystal oscillator separate from the Processor 405, or a signal derived from the output of a crystal oscillator, or a frequency source derived from signals present inside the Processor 405, such as a divisor of the fundamental clock frequency of the Processor. The Modulated Signal 411, in this embodiment is the result of modulating the Uplink Information Signal 406 onto the Subcarrier Signal 409. The Modulated Signal 411 then is used by Detector/Modulator 402 to modulate the RF signal received from Tag 105 to produce a modulated backscatter (i.e., reflected) signal. This may be accomplished by switching on and off the Schottky diode of the Detector/Modulator 402 using the Modulated Signal 411, thereby changing the reflectance of Antenna 401. A Battery 430 or other power supply such as a voltage circuit 420 (which can be a coil for example) provides power to the circuitry of Tag 105. Although the use of a subcarrier is not essential, it has been found that advantages are present to a modulated backscatter design that uses a single frequency subcarrier. Using such a subcarrier, many modulation schemes are possible; e.g., Phase Shift Keying (PSK) of the subcarrier (e.g., BPSK, QPSK), or more complex modulation schemes (e.g., MSK, GMSK), etc.

Returning to FIG. 3, the Transceiver 103 receives the modulated backscatter signal with the Receive Antenna 310, amplifies the signal with a Low Noise Amplifier 309, and demodulates the signal using a Mixer 308. In some Transceiver designs, a single transmit/receive antenna is used. In this event, an electronic method of canceling the transmitted signal from that received signal by the receiver chain is needed. This could be accomplished by a device such as a circulator. In some designs, the Mixer 308 is a Quadrature Mixer. Using the same RF Signal 302 in the Mixer 308 as is used in the transmit chain means the demodulation to baseband is done using Homodyne detection; this has advantages in that it reduces phase noise in the receiver circuits. The Mixer 308 then sends the Demodulated Signal 311 (if a Quadrature Mixer, it would send both I (in phase) and Q (quadrature) signals) to the Filter Amplifier 307. The resulting filtered signal is then demodulated in the Demodulator 306, which sends the recovered signal to the Processor 300 to determine the content of the message and to determine what actions to take.

Thus, in modulated backscatter, when the Transceiver 103 desires to receive communications from the Tag 105, the Transceiver 103 typically generates a CW RF Signal 302 from the Radio Signal Source 301, which is sent in an unmodulated fashion through the Modulator 303 to the Transmitter 304 and transmitted by the Transmitter Antenna 315. Thus, the signal received by the Antenna 401 of the Tag 105 is an unmodulated CW signal. The Tag 105 then modulates a Modulated Signal 411 onto the received unmodulated CW signal, which is transmitted by the Antenna 401 back to the Transceiver 103. Thus, the radio signal originally generated in the Radio Signal Source 301 propagates from the Transceiver 103 to the Tag 105, and is then reflected and re-transmitted from the Tag 105 back to the Transceiver 103, thus encompassing two transmission paths.

One single transmission path in free space, with a line of sight path between the two endpoints, propagates according to a square law of propagation; i.e., the signal strength received at the endpoint varies inversely with the square of the distance between the endpoints. In modulated backscatter there are two transmission paths, one path from the Transceiver 103 to the Tag 105, and the other from the Tag 105 to the Transceiver 103. Therefore in modulated backscatter the signal strength received back at the originating endpoint varies inversely as the fourth power of the distance between the endpoints. Indeed, if a line of sight path between the endpoints does not exist, the signal strength could vary inversely according to powers greater than four. Thus, in modulated backscatter, the signal strength decreases rapidly with increasing distance, making MBS an excellent candidate for a wireless communications technology which has a relatively sharp dividing line between areas in which communications are possible and areas in which communications are not possible.

Using the above techniques as an example, an inexpensive, short-range, bi-directional digital radio communications channel using modulated backscatter is implemented. These techniques are inexpensive as the components are (for example) a Schottky diode, an amplifier to boost the signal strength, bit and frame synchronization circuits, an inexpensive 4 or 8 bit microprocessor, subcarrier generation circuits, and a battery or coil. Most of these items are already manufactured in quantities of millions for other applications, and thus are fairly inexpensive. Many of the circuits mentioned above can be implemented in custom logic surrounding the microprocessor core.

Maximizing Tag 105 Life

Once the Tags 105 are placed in their proper locations, as shown in FIGS. 1 and 2, it is desirable for no further maintenance on the Tags 105 to take place for a considerable length of time. This means either that the Tags 105 are powered externally, or that the Tags 105 are powered by a Battery 430 and designed in such a way to maximize battery life. Several illustrative ways to maximize Tag 105 life are now discussed.

Figure 4:
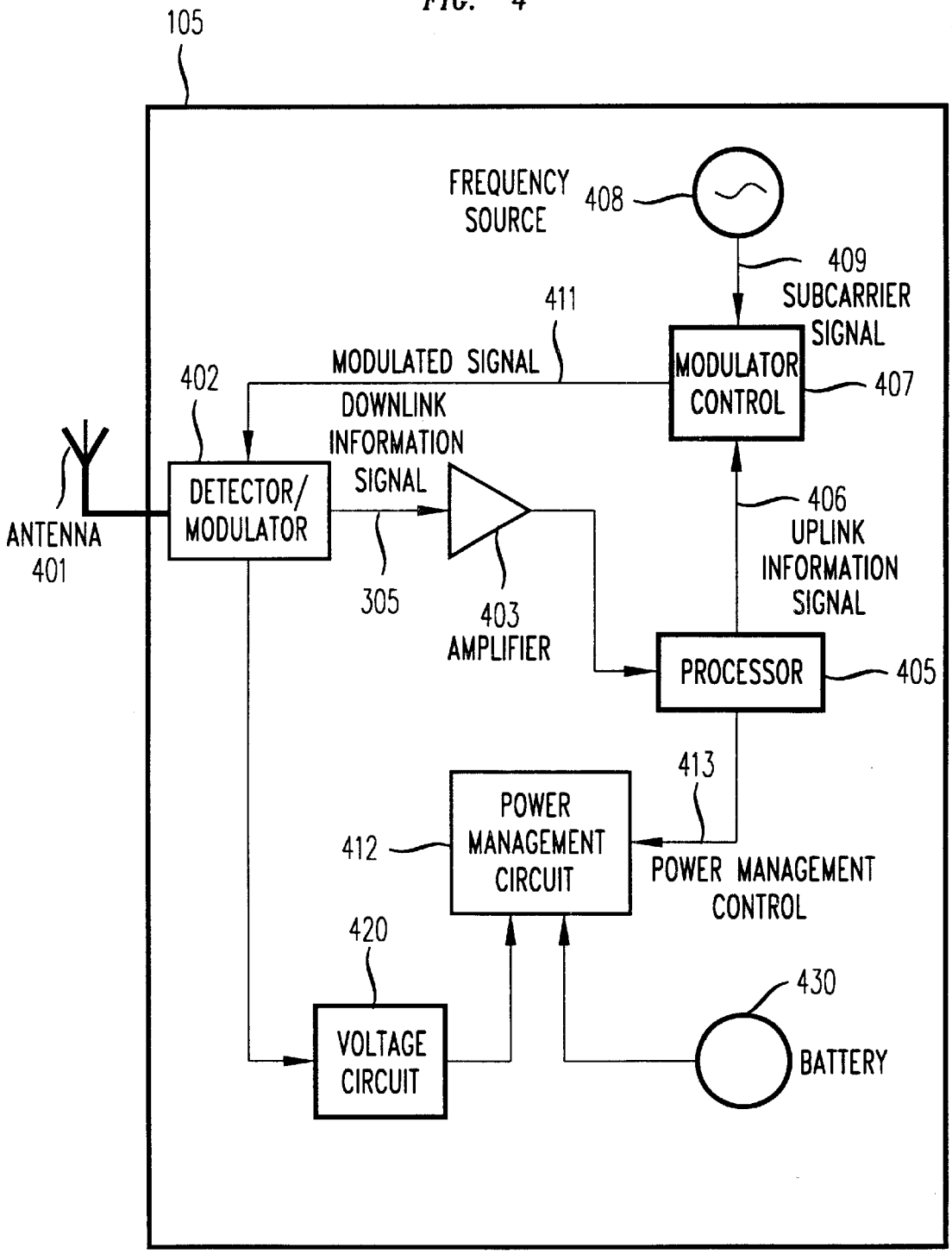
FIG. 4 shows a block diagram of an illustrative Tag used in the Wireless Security System of FIG. 1.

In one embodiment, the Tag 105 has no internal source of power. In this event, one mechanism for obtaining electrical power is to obtain power from the RF energy of the received RF signal. As seen in FIG. 4 the output of the Detector/Modulator 402 is directed towards a Voltage Circuit 420, which illustratively uses diodes in a voltage doubling configuration to generate a voltage sufficient to operate the electronics of the Tag 105. Although this embodiment will operate properly, it relies on the incident RF energy for Tag 105 powering. Due to governmental restrictions governing the emissions of RF radiation, it is likely that the Tag 105 would have to be within a few feet of the Transceiver 103, and perhaps considerably closer than a few feet, for there to be sufficient incident RF energy to activate the Voltage Circuit 420 and generate sufficient voltage for Tag 105 operation. This very short effective range would likely require that Tags 105 be located very frequently along the (for example) Predetermined area Perimeter 220, thus increasing the cost of Tags 105 and the cost of installation of the system.

In another embodiment, the Tag can be powered by a Battery 430. To maximize the Battery 430 lifetime, a standard technique is to turn off all or most of the electronic circuitry in Tag 105 for a period of time, and then awaken the Tag 105 for a sufficient time interval to allow the Tag 105 to determine if it is in the presence of a Transceiver 103 that desires to communicate with the Tag 105. In the Tag 105 design shown in FIG. 4, such a sleep and wakeup function could be illustratively located in the Processor 405; many commercial microprocessors have such sleep and wakeup capabilities already implemented. When the Processor 405 enters a sleep mode, a Power Management Control signal 413 is sent to a Power Management Circuit 412 directing it to disconnect the Battery 430 from other parts of the Tag 105, such as the Frequency Source 408, the Modulator Control 407, and the Amplifier 403. Power would not be disconnected from the Processor 405 to allow the Processor 405 to re-awaken itself. Also, illustratively, the Power Management Circuit 412 could implement a sleep and wakeup function independent of the Processor 405. In this case, the Power Management Circuit 412 would disconnect the Battery 430 from all other parts of the Tag 105. When the Tag 105 returns to the powered-on state, that is once the Power Management Circuit 412 has powered on the Tag 105, the Tag 105 then searches for a signal from the Transceiver 103 directing the Tag 105 to communicate using modulated backscatter. An illustrative technique to detect the presence of a Transceiver 103 is discussed below. If no such Transceiver 103 is detected after a certain period of time, then the Tag 105 can direct the Processor 405 or the Power Management Circuitry 420 (as discussed above) to re-enter sleep mode.

In still another embodiment, the Tag 105 does not cycle its power on and off in a regular manner. Rather, the Tag's 105 normal configuration is for the power from the Battery 430 to be disconnected from the rest of the Tag 105 by the Power Management Circuit 412. In this embodiment, the Voltage Circuit 420 is enhanced to contain a circuit that has the capability to detect the presence of incident RF energy received by the Antenna 401. Illustratively, a Schottky diode used as a Detector/Modulator 402 can be designed as a "zero-bias detector." This means that the Schottky diode can detect Amplitude Modulated signals transmitted by the Transceiver 103 even if the Schottky diode is not currently "biased" by a certain voltage. In this case, the only circuitry required to be operational at all times is a relatively small amplifier stage which amplifies these analog signals and compares them to a fixed voltage level. If the fixed voltage level is exceeded, then it is assumed that the Tag 105 is in the presence of a Transceiver 103, and then the Power Management Circuit 412 activates the remainder of the Tag 105 by connecting the Battery 430 to the rest of the circuitry. The radio communications then proceeds as described above for the other embodiments. The Tag 105 can then return to the "sleep"—i.e., unpowered—mode. For example, the Tag 105 can return to the sleep mode after the Tag 105 has transmitted a certain number of Uplink Information Signals 406.

Detailed Wireless Security System Operation

In one embodiment of the security system, the system simply alerts the mobile unit when it comes near a Tag 105 marking the boundary line between safe and unsafe areas, i.e. the boundary line of the predetermined area. The Transceiver will, illustratively, transmit an Downlink Information Signal 305 to the Tag 105 on a regular basis. This Downlink Information Signal 305 could be a series of Amplitude Modulated pulses of specific order or character. The Detector/Modulator 402 of the Tag 105 demodulates these pulses, transmits them to the Amplifier 403 which then transmits them to the Processor 405. The Processor 405 determines if these pulses conform to the predetermined pattern transmitted by the Transceiver 103. If yes, then the Processor 405 constructs an Uplink Information Signal 406 which contains data indicating that a Tag 105 has detected the Downlink Information Signal 305 pulses sent by a Transceiver 103. In this embodiment, the content of the Uplink Information Signal 406 can be very simple. Illustratively, the Uplink Information Signal 406 could be a single bit of information—i.e., a "yes", indicating that this Tag 105 did in fact detect the Downlink Information Signal 305—modulated by the Modulator Control Circuit 407 onto a single frequency Subcarrier Signal 409. The Demodulated Signal 311 received by the Transceiver 103 would then be an unmodulated signal at the frequency of the Frequency Source 408. The Filter/Amplifier 307 and Demodulator 306 would then simply detect the presence or absence of this unmodulated signal, most commonly by comparing the signal strength at that frequency against a threshold signal strength. If the Demodulator 306 determined that such an unmodulated signal is present, then the Transceiver 103 would know that it was within radio range of Tag 105, and the Transceiver 103 would provide some type of stimulus to the mobile unit to which this Transceiver 103 is attached. This could be accomplished by the Processor 300 sending out a stimulus signal. Such a stimulus signal could potentially be auditory (a musical note or tone, or a verbal message), or perhaps electrical (a small electrical shock to the pet), although the stimulus signal can be any kind of stimulus. Alternatively, the Transceiver 103 can provide an alert either in addition to or instead of the stimulus. Preferably the alert is be given to whomever is responsible for the mobile unit. For example, the alert can be delivered to a person responsible for the mobile unit, or to a security system that would then cause the predetermined area to be locked down. The alert can be auditory, or electrical. In one embodiment, the alert is a phone call or page that delivers a mess age to a person notifying the person that the mobile unit has come close to a Tag. The alert can be provided by alert generator 320.

In this embodiment, the Transceiver 103 does not need to know which specific Tag 105 was the cause of the received unmodulated signal. Indeed, it is possible that two or more Tags 105 were simultaneously within radio range of the Transceiver 103, and all of the Tags 105 within range could have contributed to the reception of the unmodulated signal. Therefore, in this embodiment there is no need for information as to the current location of the Transceiver 103 (and thus of the mobile unit).

In an alternate embodiment, it is possible to enable the Tag 105 and the Transceiver 103 to determine with which Tag 105 the Transceiver 103 is in communication. In this embodiment, the Transceiver 103 begins with the transmission of a Downlink Information Signal 305 that is similar to or identical to that discussed in the above embodiment. The Tag 105 utilizes power management techniques as discussed above. The Tag 105 further detects the presence of the Downlink Information Signal 305 as discussed above and informs the Processor 405, again as above. In this embodiment, the Processor 405 generates an Uplink Information Signal 406 that contains a piece of information unique to this Tag 105, including a unique electronic identifier. Thus, the Modulated Signal 411 would include this unique identifier. The Transceiver receives the Modulated Signal 411 and Filter/Amplifier 307 filters the signal illustratively with a center frequency at the frequency of the Frequency Source 408. The bandwidth of the filter is designed to be greater than the occupied bandwidth of the Modulated Signal 411. The Demodulator 306 then recovers the Uplink Information Signal 406 from the received signal using conventional demodulation techniques, the specific techniques depending upon the type of modulation (BPSK, QPSK, etc.). In this embodiment, if more than one Tag 105 is located within radio range of a Transceiver 103, then "collisions" between the Uplink Information Signals 406 from separate Tags 105 might occur, thus causing the Demodulator 306 to be unable to accurately demodulate a particular such Uplink Information Signal 406. A number of techniques are known to solve this problem, one illustratively being the technique called Aloha, in which each Tag waits a random amount of time after receiving the Downlink Information Signal 305 before transmitting the Uplink Information Signal 406. Using these techniques, the Transceiver 103 can be informed of the unique identifiers of all Tags 105 in radio range of the Transceiver. The Transceiver 103 can then apply a stimulus to the mobile unit as discussed above.

Figure 5:
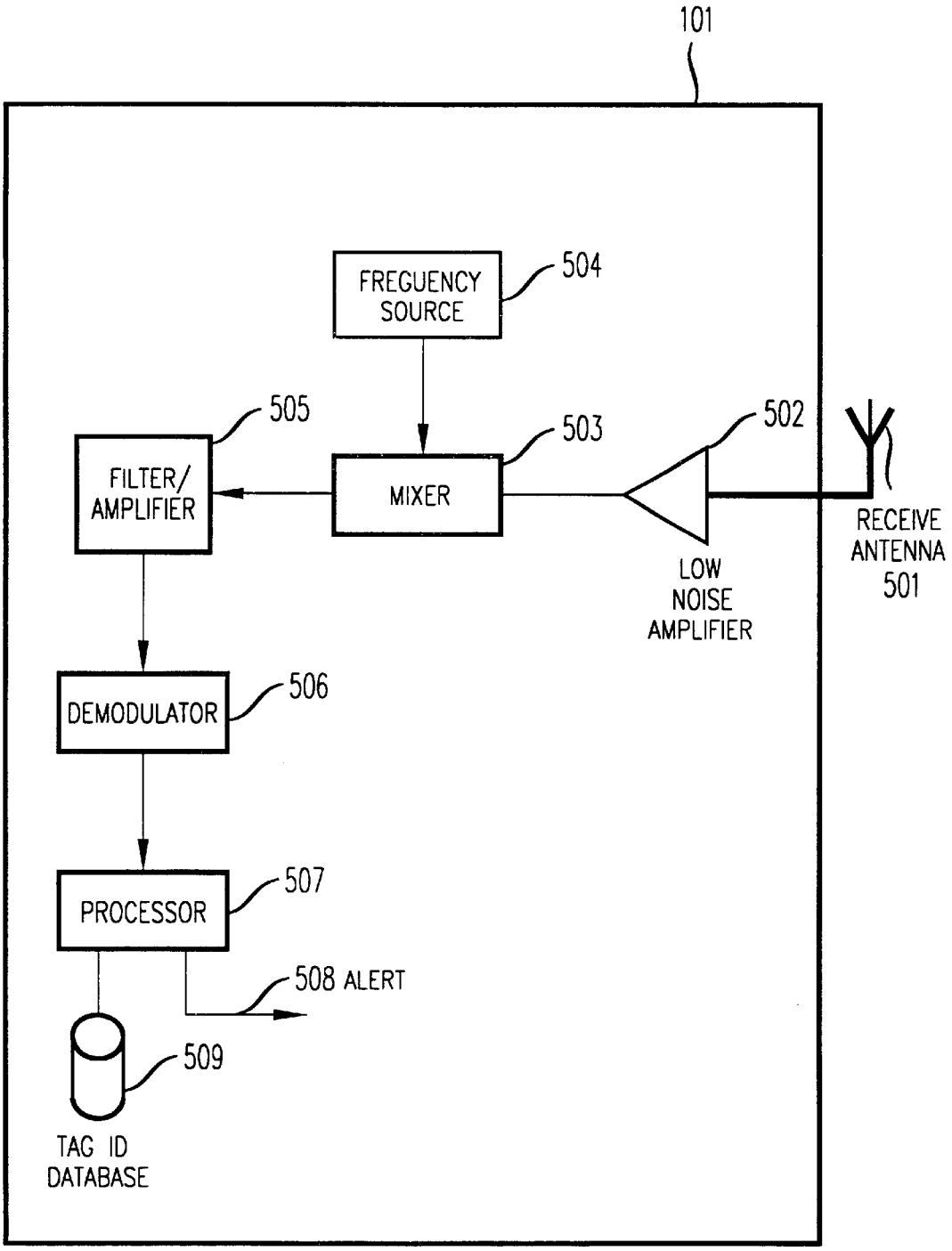
FIG. 5 shows a block diagram of an illustrative Central Control Station used in the Wireless Security System of FIG. 1.

In addition to, or instead of, the application of a stimulus, the Central Control Station 101 can be informed of the unique identifier of any Tag 105 that is in radio contact with the Transceiver 103. For example, it is possible that particular Tags 105 have been pre-determined to be "extremely hazardous"—i.e., that if the Transceiver 103 comes into radio range of these specific Tags 105, then an alert should be given, preferably the alert should be given to whomever is responsible for the mobile unit. To accomplish this, the Transceiver 103 could generate a more complex Downlink Information Signal 305 which includes the unique identification numbers of any Tag 105 with which the Transceiver 103 comes into communication. This more complex Downlink Information Signal 305, including the Tag 105 unique identification numbers, is then modulated in the Modulator 303, transmitted by the Transmitter 304, and received by the Central Control Station 101. FIG. 5 shows an illustrative Central Control Station 101. The Central Control Station 101 illustratively includes a Low Noise Amplifier 502, a Mixer 503 and Frequency Source 504 to demodulate the incoming RF signal to baseband, a Filter/Amplifier 505 to filter and amplify the received signal, and a Demodulator 506 to recover the complex Downlink Information Signal 305. It is not necessary for the modulation technique used for communications between the Transceiver 103 and the Central Control Station 101, to be the same modulation technique as used between the Transceiver 103 and the Tags 105. Indeed, it is most likely that the Transceiver 103 to Tag 105 modulation scheme will be relatively simple, such as Amplitude Shift Keying, for reasons discussed above. For Transceiver 103 to Central Control Station 105 communications, any number of modulation techniques could be used, such as Phase Shift Keying or Spread Spectrum techniques.

Once the Downlink Information Signal 305 is recovered by the Central Control Station 101, the information contained within the Downlink Information Signal 305 can be processed by the Processor 507 and stored in a Tag ID Database 509. The Tag ID Database would then contain a record of those Tags 105 that came into range of the Transceiver. Alternatively, only information pertaining to those Tags 105 that are considered to be "dangerous" could be stored in the Tag ID Database 509. The Tags can store whether they are considered dangerous, or the Tag ID Database 509 could contain the identity of the Tags considered dangerous. In the later case, the Processor can compare the identity of the Tags with the information store in the Tag ID Database 509 to determine if the Tag is considered dangerous. If the Processor 507 detects that the Transceiver 103 has come close to a dangerous Tag 105, then the Processor 507 could generate and direct an alert signal 508 notifying that the Transceiver 103 has come close to a dangerous Tag. For example, the Processor 507 could direct the alert signal 508 to be delivered to a person responsible for the mobile unit, or the Processor 507 could direct the alert signal 508 to be delivered to a security system that would then cause the predetermined area to be locked down. The alert signal 508 could be auditory, or electrical. In one embodiment, the alert is a phone call or page that delivers a message to a person notifying the person that the mobile unit has come close to a dangerous Tag. Either or both the stimulus and the alert can be generated either when the Transceiver 103 comes into range of a Tag 105, that is considered dangerous, or when the Transceiver 103 comes into contact with any of the Tags 105.

Note that there is a considerable difference in the effective range between the Transceiver 103 and the Tags 105, and between the Transceiver 103 and the Central Control Station 101. The range between the Transceiver 103 and the Tags 105 is very short, in part because the Detector/Modulator 402 is a very inefficient signal detector. However, the Central Control Station 101 can have a much more sophisticated radio receiver which could successfully receive signals at a much greater distance even with the same transmit power output from the Transmitter 304.

Transceiver 103 Design

Since the Transceiver 103 is attached to the mobile unit, it is important that the Transceiver 103 not be excessively large, heavy, or require excessive amounts of electric power. Until recently, radio designs such as the Transceiver 103 illustratively shown in FIG. 3 have been relatively large, since in many cases each component shown in FIG. 3 is separately designed and fabricated.

Figure 6:
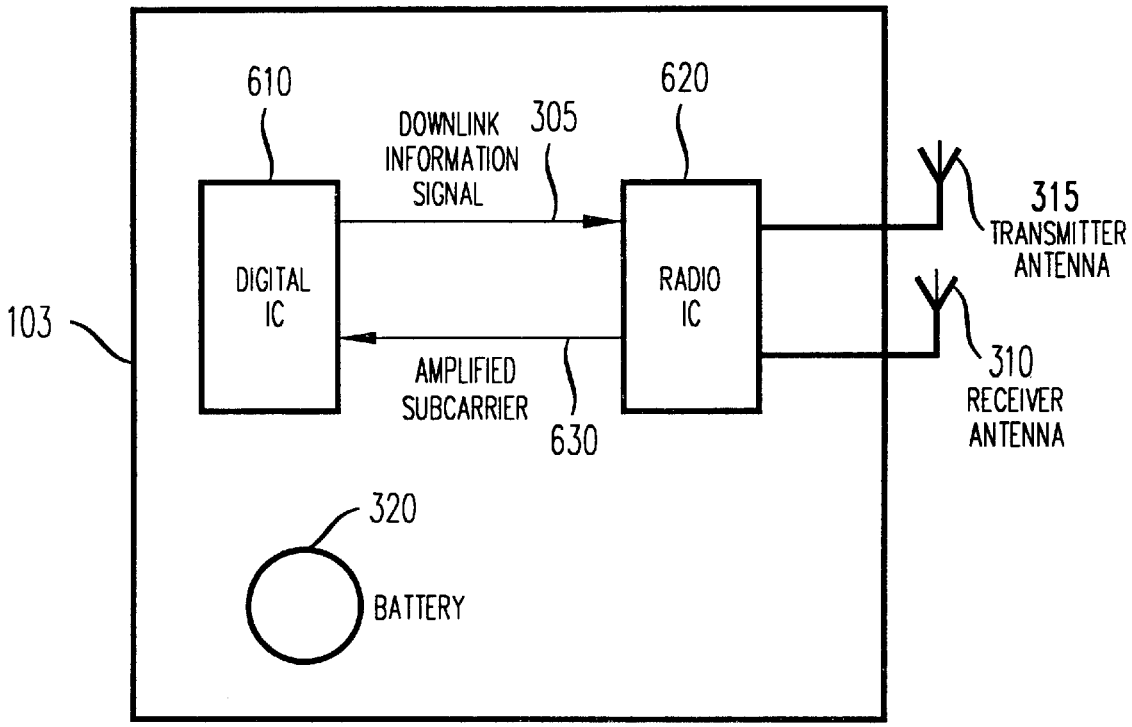
FIG. 6 shows a block diagram of an illustrative embodiment of the Transceiver used in the Wireless Security System of FIG. 1 where the Transceiver has two Integrated Circuits (ICs), a Digital IC and a Radio IC.

It is possible to consider the design of a Transceiver 103 which would follow the block diagram of a Transceiver 103, as shown in FIG. 3, but which would utilize a minimum number of electronic integrated circuits. In one example, FIG. 6 shows a Transceiver design that has two Integrated Circuits (ICs). In this design the functions of the Transceiver 103 are separated into two IC's; a Digital IC 610 and a Radio IC 620.

Figure 7:
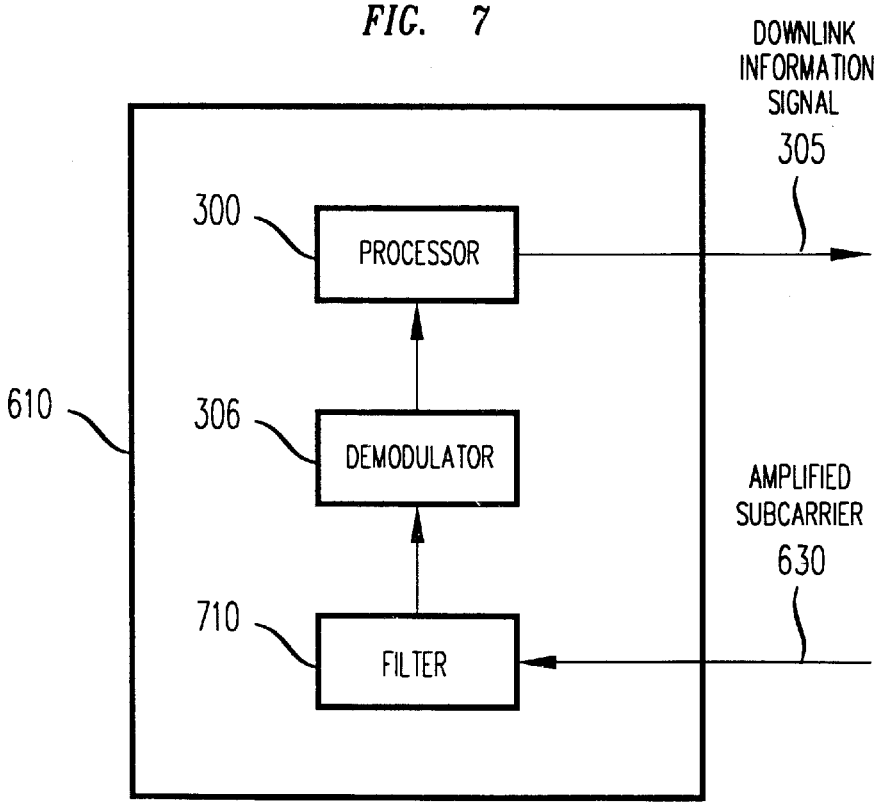
FIG. 7 shows a block diagram of an illustrative Digital IC used in the Transceiver of FIG. 6.

FIG. 7 shows a block diagram of the Digital IC 610, which includes the Processor 300 and the Demodulator 306.

Figure 8:
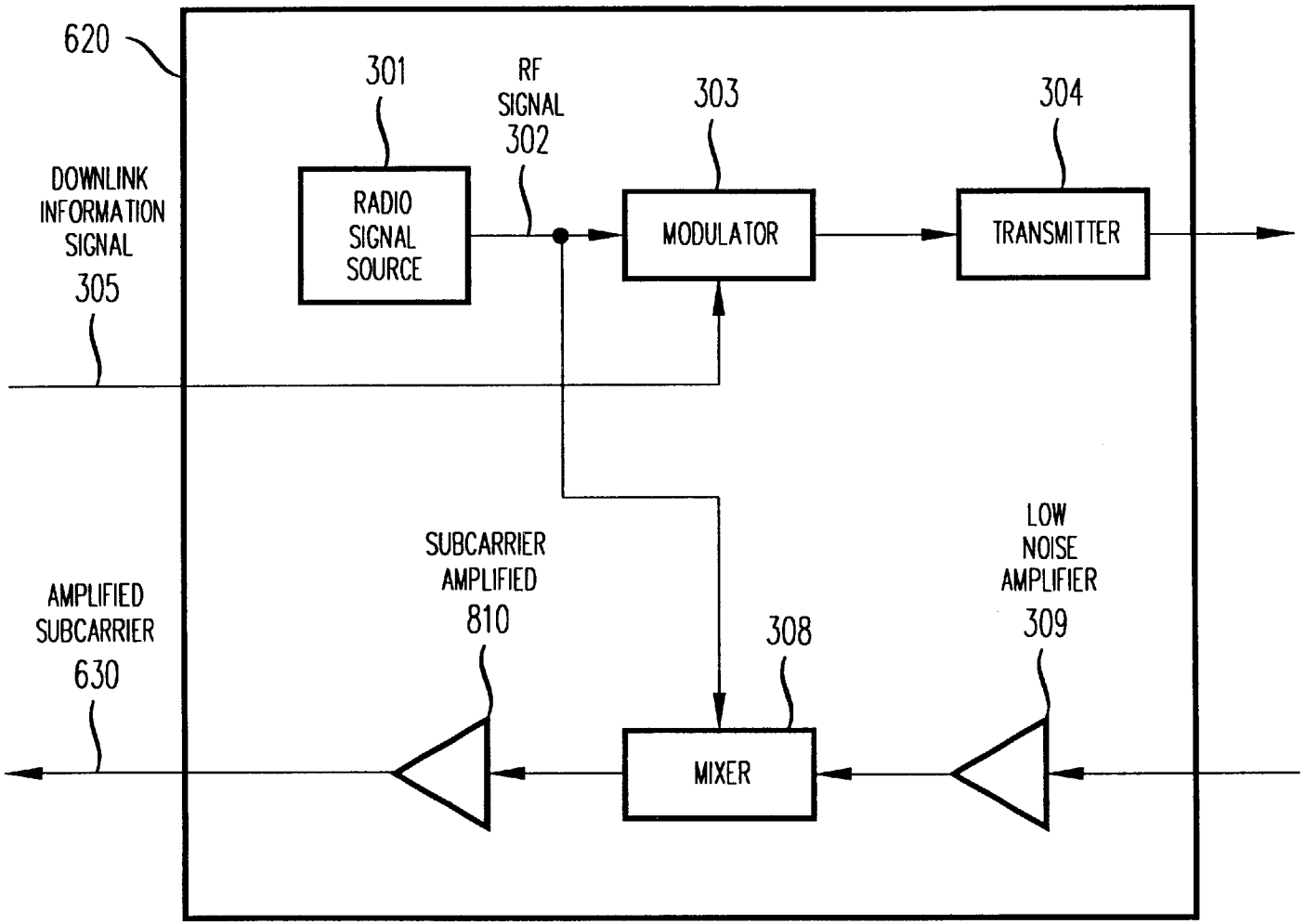
FIG. 8 shows a block diagram of an illustrative Radio IC used in the Transceiver of FIG. 6.

The functions of the Filter/Amplifier 307 have been divided into that of a Filter 710 and a Subcarrier Amplifier 810 (shown in FIG. 8). The Transceiver is divided into the Digital IC 610 and a Radio IC to separate out those functions which could be performed digitally in a CMOS IC, or those functions which do not require high frequency (i.e. RF) signal response. The functions being performed in the Filter 710 and the Demodulator 306 could be programmed as digital processes into the Processor 300; alternatively, those functions could be implemented in custom logic surrounding the Processor 300 core on an IC.

The functions of the Radio IC 620 are illustratively shown in FIG. 8. The input to the Radio IC 620 is the Downlink Information Signal 305, and the output from the Radio IC 620 is the Amplified Subcarrier 630. The Radio IC 620 also has connections to the Transmitter Antenna 315 and to the Receive Antenna 310. As discussed above, other embodiments of modulated backscatter could utilize a single Transmit/Receive Antenna. In the Radio IC 620, the Radio Signal Source 301 generates an RF Signal 302, which is then modulated by the Downlink Information Signal 105 in the Modulator 303. This modulated RF signal is then transmitted by the Transmitter 304. The reflected modulated signal received from the Tag 105 is then received by the Receive Antenna 310 and amplified by the Low Noise Amplifier 309 which operates at the RF frequency. The amplified signal is then demodulated, illustratively here using Homodyne detection, in the Mixer 308. The output of the Mixer 308 is then amplified by the Subcarrier Amplifier 810 whose circuits must operate not at RF frequencies but at the frequency of the Frequency Source 408 which generates the Subcarrier Signal 409. Subcarrier frequencies are generally much less than RF frequencies; generally Subcarrier of frequencies below a few Megahertz are utilized. All of these components operate at either RF frequencies, which could be as high as several Giga Hertz, or at frequencies up to a few Megahertz. These functions can be implemented in an IC process designed for high frequency operation, such as a Bipolar silicon processor, or a Gallium Arsenide process.

One of the major causes of current consumption and heat dissipation in the Transceiver 103 is the Transmitter 304. For some modulated backscatter applications, transmit powers of one Watt or more are utilized, in order to maximize the effective system range between the Transceiver 103 and the Tag 105. However, for this application, the goal is not to maximize system range, but rather to design the system to support a range large enough such that an excessive number of Tags 105 are not required. Typically, the output power of the Transmitter 304 could be reduced to under 50 Milli Watts (+17 dBm) and still maintain a range from Transceiver 103 to Tag 105 of approximately 15 feet. Thus, Tags 105 could be placed every 20–30 feet along the perimeter of the predetermined area. This transmit power could be supported within a high frequency IC. If power dissipation problems exist, a separate power amplifier IC could be designed and placed inside a Multi-Chip Module, together with another IC to perform the other functions of FIG. 8, the Multi-chip Module would then comprise the Radio IC 620.

The foregoing is merely illustrative. Thus, for example, in the illustrative embodiment the RF signal is transmitted from the Transceiver 103 to at least one of the Tags 105. The Tag 105 backscatter modulates a reflection of the RF signal to produce a reflected modulated signal. The reflected modulated signal is then received at the Transceiver 103. In one alternative embodiment of the invention, the reflected modulated signal can be received at the central control station 101 instead of at the Transceiver. To facilitate the reception of this signal, the central control station should have as close a copy of the RF Signal 302 as possible. It may be possible for the central control station 101 to "listen" for the RF Signal 302, and using frequency and phase locking techniques, reconstruct a signal as close as possible to RF Signal 302 for use in demodulating the reflected modulated signal.

Additionally, in another alternative embodiment of the invention, instead of backscatter modulating a reflection of the RF signal to produce a reflected modulated signal, the Tag 105 records the receipt of the RF signal. The central control station 101 then transmits a second RF signal to the Tag 105. The Tag receives the second signal and backscatter modulates a reflection of the second RF signal to produce the reflected modulated signal. The reflected modulated signal is then received at the central control station. In this embodiment, the central control station contains transmitter and receiver circuitry which could be similar to that shown in FIG. 3, with the possible exception that the RF power from the Transmitter 304 may be greater than that used by the Transceiver 103, since the range from the central control station 101 to the Tag 105 is greater than the range from the Transceiver 103 to the Tag 105.

While the invention has been described with reference to a preferred embodiment, it will be understood by those skilled in the art having reference to the specification and drawings that various modifications and alternatives are possible therein without departing from the spirit and scope of the invention.

What is claimed is:

1. A system comprising:

a mobile transmitter;

a plurality of boundary tags for receiving communications from the mobile transmitter, at least one of the plurality of boundary tags having a unique identifier; and a mobile transceiver that comprises the mobile transmitter and a mobile receiver; and a central control station for communicating with the receiver, the central control station comprising a processor programmed to determine if the transmitter is communicating with at least one boundary tag whose unique identifier matches at least one predetermined unique identifier.

2. A system comprising:

a mobile transmitter;

a plurality of boundary tags for receiving communications from the mobile transmitter, at least one of the plurality of boundary tags has a unique identifier; and a processor in communication with the transmitter, the processor programmed to determine if the transmitter is communicating with at least one boundary tag whose unique identifier matches at least one predetermined unique identifier.

3. The system of claim 2, further comprising a mobile transceiver that comprises the mobile transmitter and a mobile receiver.

4. The system of claim 3, further comprising a stimulus generator responsive to the receiver.

5. The system of claim 3, further comprising an alert generator responsive to the receiver.

6. The system of claim 3, further comprising a central control station for communicating with the receiver.

7. The system of claim 6, wherein the central control station further comprises an alert generator.

8. The system of claim 2, further comprising a central control station for communicating with at least one of the plurality of boundary tags.

9. A system comprising:

a mobile transmitter;

a plurality of boundary tags for receiving communications from the mobile transmitter; and a central control station for communicating with at least one of the plurality of boundary tags, the central control station comprises a receiver for receiving a reflected modulated signal from the at least one of the plurality of boundary tags.

10. The system of claim 9, wherein:

at least one of the plurality of boundary tags has a unique identifier; and the central control station comprises a processor programmed to determine if the mobile transmitter is communicating with at least one boundary tag whose unique identifier matches at least one predetermined unique identifier.

11. A system comprising:

a mobile transmitter;

a plurality of boundary tags for receiving communications from the mobile transmitter; and a central control station for communicating with at least one of the plurality of boundary tags, the central control station comprises a transceiver for transmitting a signal to the at least one of the plurality of boundary tags and for receiving a reflected modulated signal from the at least one of the plurality of boundary tags.

12. A method of operating a security system having a plurality of boundary tags and a central control station, the method comprising the steps of:

transmitting a first signal from a mobile transmitter;

receiving the first signal using at least one boundary tag of the plurality of boundary tags;

determining if the mobile transmitter has come into proximity of the at least one boundary tag by receiving a reflected modulated signal from the at least one boundary tag;

providing a response when the mobile transmitter comes into proximity of the at least one boundary tag; and receiving the reflected modulated signal at the central control station.

13. A method of operating a security system having a plurality of boundary tags and a central control station, the method comprising the steps of:

transmitting a first signal from a mobile transmitter;

receiving the first signal using at least one boundary tag of the plurality of boundary tags;

determining if the mobile transmitter has come into proximity of the at least one boundary tag by receiving a reflected modulated signal from the at least one boundary tag;

providing a response when the mobile transmitter comes into proximity of the at least one boundary tag;

recording the receipt of the first signal at the at least one boundary tag;

transmitting a second signal from the central control station to the at least one boundary tag;

receiving the second signal at the at least one boundary tag; and receiving the reflected modulated signal at the central control station.

14. The method of claim 13, wherein the step of determining if the mobile transmitter has come into proximity of at least one boundary tag comprises determining whether the at least one boundary tag received the second signal.

15. A method of operating a security system having a plurality of boundary tags and a central control station, and the method comprising the steps of:

transmitting a first signal from a mobile transmitter;

receiving the first signal using at least one boundary tag of the plurality of boundary tags at least one of the plurality of boundary tags has a unique identifier;

determining if the mobile transmitter has come into proximity of the at least one boundary tag by receiving a reflected modulated signal from the at least one boundary tag, the reflected modulated signal includes the unique identifier;

providing a response when the mobile transmitter comes into proximity of the at least one boundary tag.

16. The method of claim 15, further comprising the step of determining if the unique identifier matches at least one predetermined unique identifier; and the step of providing the response when the mobile transmitter comes into proximity of the at least one boundary tag comprises providing the response when the unique identifier matches at least one predetermined unique identifier.

17. The method of claim 15, further comprising the step of transmitting the unique identifier to a central control station.

18. The method of claim 17, further comprising the step of determining if the unique identifier matches at least one predetermined unique identifier; and wherein the step of providing the response when the mobile transmitter comes into proximity of the at least one boundary tag comprises providing the response when the unique identifier matches at least one predetermined unique identifier.

* * * * *